US008684423B2

(12) United States Patent
Stuberg et al.

(10) Patent No.: US 8,684,423 B2
(45) Date of Patent: Apr. 1, 2014

(54) PUSH CATCH

(75) Inventors: Gunnar Stuberg, Werdohl (DE); Christiane Schmale, Luedenscheid (DE)

(73) Assignee: Schmale GmbH & Co. KG, Luedenscheid (DE)

( * ) Notice: Subject to any disclaimer, the term of this patent is extended or adjusted under 35 U.S.C. 154(b) by 0 days.

(21) Appl. No.: 13/698,713

(22) PCT Filed: May 14, 2011

(86) PCT No.: PCT/DE2011/001076

§ 371 (c)(1),
(2), (4) Date: Jan. 4, 2013

(87) PCT Pub. No.: WO2011/144203

PCT Pub. Date: Nov. 24, 2011

(65) Prior Publication Data

US 2013/0134166 A1 May 30, 2013

(30) Foreign Application Priority Data

May 20, 2010 (DE) ..... 10 2010 020 945

(51) Int. Cl.
*E05C 1/04* (2006.01)

(52) U.S. Cl.
USPC ..... 292/163; 292/DIG. 11; 292/DIG. 37; 220/260

(58) Field of Classification Search
USPC ..... 220/260, 262–264, 281; 70/63, 69; 292/1, 137, 138, 145, 163, 174, 175, 292/DIG. 11, DIG. 37; 206/1.5
See application file for complete search history.

(56) References Cited

U.S. PATENT DOCUMENTS

| | | | | |
|---|---|---|---|---|
| 1,434,370 | A * | 11/1922 | Crompton et al. | 292/163 |
| 4,930,528 | A * | 6/1990 | Hatakeyama | 132/301 |
| 7,695,031 | B2 * | 4/2010 | Jackson et al. | 292/169 |
| 2007/0034637 | A1 * | 2/2007 | Carmichael | 220/835 |
| 2011/0011862 | A1 * | 1/2011 | Matsumoto et al. | 220/234 |

FOREIGN PATENT DOCUMENTS

| | | |
|---|---|---|
| DE | 13 77 226 | 6/1936 |
| DE | 652 754 | 11/1937 |
| DE | 201 14 060 | 11/2001 |
| JP | 2004-209029 | 7/2004 |

OTHER PUBLICATIONS

International Search Report of PCT/DE2011/001076 date of mailing Jan. 24, 2012.

* cited by examiner

*Primary Examiner* — J. Gregory Pickett
*Assistant Examiner* — James Way
(74) *Attorney, Agent, or Firm* — Collard & Roe, P.C.

(57) ABSTRACT

The invention relates to a push catch (2) for a container (1) with a lower part (11) and a cover (12), the push catch including a push element (21) which corresponds to a locking bolt (4). The locking bolt (4) is at least partially surrounded by a spring (43) which acts on a bushing (44) when the cover is in the closed state. The bushing (44) can be moved along the longitudinal center line of the locking bolt (4) and is supported on the lower part (11).

3 Claims, 1 Drawing Sheet

PUSH CATCH

CROSS REFERENCE TO RELATED APPLICATIONS

Figure 1:
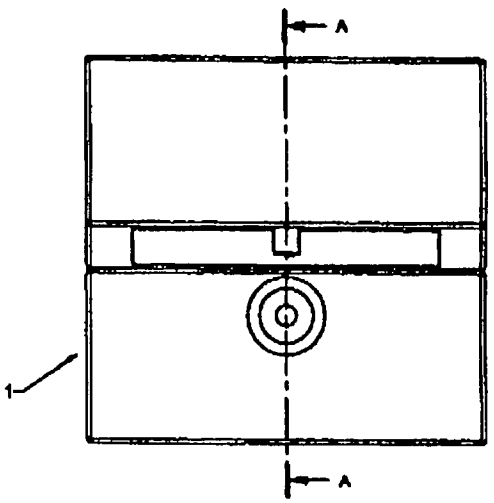

This application is the National Stage of PCT/DE2011/001076 filed on May 14, 2011 which claims priority under 35 U.S.C. §119 of German Application No. 10 2010 020 945.7 filed on May 20, 2010, the disclosure of which is incorporated by reference. The international application under PCT article 21(2) was not published in English.

The invention relates to a push catch for containers having a lower part and a lid, comprising a push element that corresponds with a locking bolt.

Push catches for containers of the type stated initially are known in many different ways. Such catches are affixed to containers, generally box-shaped containers such as crates, boxes or cases made of wood, plastic, or the like. In the known catches, the locking bolt affixed to the lid is released by means of activation of the push element, so that the lid can be opened. In this connection, activation of the lid by hand is required, in each instance. In order to increase the impression of quality, particularly in the case of containers for storage of high-value products, such as in the case of jewelry boxes or watch cases, beverage packaging, and the like, it is the task of the present invention to create a push catch that allows automatic opening of the lid.

According to the invention, this task is accomplished in that the locking bolt is surrounded, at least in part, by a spring that acts, in the closed state of the lid, on a bushing that can be moved along the longitudinal center line of the locking pin and that supports itself on the lower part.

With the invention, a push catch for containers is created, which results in automatic opening of the lid when the push element is activated. This is brought about in that the spring that surrounds the locking bolt acts on the bushing. In the closed state, the spring is biased, so that upon release of the locking bolt by the push element, this bias is released, resulting in opening of the lid. Upon activation of the push element, the lid springs open, which brings with it a clearly greater impression of quality of the container.

In a further development of the invention, the locking bolt is surrounded by a sleeve in which the bushing is guided. With the help of this sleeve, perfect guidance of the bushing is brought about, so that the reliability of the function of the push catch is guaranteed in every case.

It is advantageous if the sleeve has a stop at its end facing the lower part, which interacts with a ring of the bushing. The stop as well as the ring on the bushing bring about the result that the bushing is affixed in the lid in undetachable manner.

At the same time, the dimension of the projection of the bushing from the lid can be varied by means of the stop.

Figure 2:
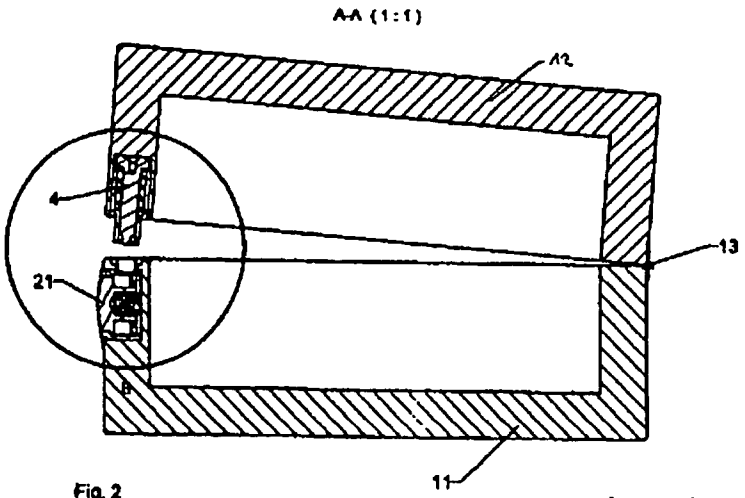
Figure 3:
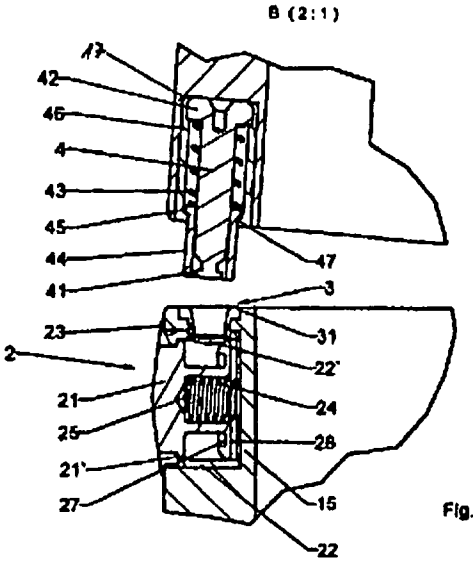

Other further developments and embodiments of the invention are indicated in the other dependent claims. An exemplary embodiment of the invention is shown in the drawing and will be described in detail below. The drawing shows:

FIG. 1 a view of a container with the lower part and the lid shown separately;

FIG. 2 the section along the line A-A in FIG. 1;

FIG. 3 the detail "B" in FIG. 2 on an enlarged scale.

The container 1 selected as an exemplary embodiment has a push catch 2. A bushing 3 is provided, through which a locking bolt 4 passes in the closed state of the container 1.

The container 1 has a lower part 11 that is closed off with a lid 12. The lower part 11 and the lid 12 are connected with one another in articulated manner, by means of a hinge 13.

In the lower part 11 of the container 1, an accommodation is provided on the side facing away from the hinge 13. The accommodation has a bottom 15 that forms the side wall of the lower part 11 of the container 1, in certain regions. A bore is introduced into the side wall of the lower part 11, from the side facing the lid 12, which bore is oriented at a right angle to the center line of the accommodation 14. The bore is configured to be offset and accommodates the bushing 3 in the assembled state. In the lid 12 of the container 1, a bore 17 is disposed, which is oriented coaxial to the bore in the lower part 11 or to the bushing 3 when the lid 12 is closed.

In the lower part 11 of the container 1, the push catch 2 is provided. The push catch 2 comprises a push element 21 that is guided in a housing 22. The housing 22 has a circumferential shoulder 23 on its end facing away from the bottom 15. The housing 22 is inserted into the accommodation from the side facing away from the bottom 15. It supports itself on the container wall with the shoulder 23. The housing 22 has a radial bore 22' that aligns with the bore in the lower part 11 of the container 1 or with the bushing 3 in the assembled state.

The push element 21 has a ring-shaped projection 21' in its region that faces away from the bottom 15. This region stands under the influence of a spring 24. The spring 24 is guided in a dead-end bore 25 in the push element 21. It supports itself, on the one hand, on the bottom of the dead-end bore 25, on the other hand on the bottom 15. On the side facing the bottom 15, the push element 21 is provided with a plate 26 that surrounds the dead-end bore 25, which plate is provided with an undercut 27 on its outer end.

The bushing 3 is provided with a passage bore. It is configured to be offset and therefore has a circumferential edge 31 on its end facing away from the push element 21. The bushing 3 projects into the bore 22' of the housing 22 in certain regions.

The locking bolt 4 is inserted into the offset bore 17 in the lid 12. The locking bolt 4 has a plate 41 on its end facing the lower part 11. Furthermore, the locking bolt 4 has a step 42 on its end facing away from the plate 41. It is partly surrounded by a spring 43, which is a helical pressure spring. A bushing 44 is provided, which can be moved along the longitudinal center line of the locking bolt. The bushing 44 has a ring 45 at its end facing the step 42, against which ring the spring 43 supports itself. The bushing 44 can be moved along the longitudinal center line of the locking bolt 4 and is guided by the locking bolt 4 on the inside. On the outside, the bushing 44 is guided, by way of its ring 45, by a sleeve 46 that is inserted into the bore 17 in the lid 12. The sleeve 46 surrounds the locking bolt 4, in part. It has a stop 47 on its end facing the lower part 11, which stop is configured in the shape of a retracted edge. The stop 47 interacts with the ring 45 of the bushing 44. Because of this interaction, the bushing 44 is disposed in the sleeve 46 in undetachable manner, as is evident, for example, in FIG. 3.

In the closed state of the container 1, in which the lid 12 lies on the lower part 11, the locking bolt 4 passes through the bushing 3 and is held captive by the undercut 27 with its plate 41. In this state, the bushing 44 supports itself on the edge 31 of the bushing 3. At the same time, the spring 43 is in contact with the ring 45 as well as the step 42. The spring 43 is compressed, in this position, so that the bushing 44 stands under the bias of the spring 43. Upon activation of the push element 21, the plate 41 of the locking bolt 4 is released by the undercut 27 of the push catch 2. Under the influence of the spring 43, the bushing 44 presses against the edge 31 and, at the same time, is pressed out of the sleeve 46. This results in an opening movement of the lid 12, until the ring 45 comes into contact with the stop 47. The spring 43 is then in the relaxed state.

During closing of the lid 12, first contact of the bushing 44 against the edge 31 of the bushing 3 takes place. During further closing of the lid 12, the bushing 44 plunges into the sleeve 46. As soon as the ring 45 comes into contact with the spring 43, the latter is pressed against the step 42 and compressed. Once the plate 41 of the locking bolt 4 has gone past the undercut 27, the catch is locked once again.

With the invention, a push catch for containers is created, which allows automatic opening of the lid upon activation of a push element, in simple and simultaneously reliable manner. This increases the value of the container, in each instance, which is particularly desirable in the case of high-value objects stored in the container in question.

The invention claimed is:

1. Push catch for containers (1) having a lower part (11) and a lid (12), wherein an accommodation is provided in the lower part (11), which has a bottom (15), comprising a push element (21) that is guided in a housing (22), which has a circumferential shoulder (23) on its end facing away from the bottom (15), with which the housing (22) supports itself on the container wall, and the housing (22) has a radial bore (22') that aligns with a bushing (3), wherein the push element (21) is provided with a plate (26) that is provided with an undercut (27) on its outer end, on the side facing the bottom (15), and the push element (21) corresponds with a locking bolt (4), wherein the locking bolt (4) has a plate (41) at its end facing the lower part (15) and is surrounded by a spring (43), at least in part, which spring acts on a bushing (44) in the closed state of the lid (12), which bushing can be moved along the longitudinal center line of the locking bolt (4) and is guided by the locking bolt (4) on the inside, and supports itself on the lower part (11), and wherein the bushing (44) has a ring (45) on its end facing a step (42), against which the spring (43) supports itself, and the ring (45) interacts with a stop (47) on the end of the lid (12) facing the lower part (11), and wherein the stop (47) is configured in the form of a retracted edge, and wherein the locking bolt (4) passes through the bushing (3) in the closed state of the container (1), and the plate (41) is held captive by the undercut (27).

2. Push catch according to claim 1, wherein the locking bolt (4) is surrounded by sleeve (46) in which the bushing (44) is guided.

3. Push catch according to claim 1, wherein the sleeve (46) has a stop (47) at its end that faces the lower part (11), which stop interacts with a ring (45) of the bushing (44).

* * * * *